US005890715A

United States Patent [19]

Gomez et al.

[11] Patent Number: 5,890,715

[45] Date of Patent: Apr. 6, 1999

[54] LINKABLE PINBALL MACHINE

[75] Inventors: George A. Gomez, Evanston, Ill.; Thomas W. Uban, Valparaiso, Ind.; Thomas M. Kopera, Villa Park, Ill.

[73] Assignee: Williams Electronics Games, Inc., Chicago, Ill.

[21] Appl. No.: 984,543

[22] Filed: Dec. 3, 1997

[51] Int. Cl.[6] ..... A63F 7/00

[52] U.S. Cl. ..... 273/118 A; 273/121 A; 273/119 A

[58] Field of Search ..... 273/118, 119, 273/121, 122

[56] References Cited

U.S. PATENT DOCUMENTS 3,582,074 6/1971 Menotti ..... 273/122 A X
4,986,543 1/1991 Heller ..... 273/121 A
5,064,196 11/1991 Gottlieb ..... 273/121 A
5,131,654 7/1992 Gottlieb et al. ..... 273/121 A
5,238,248 8/1993 Gottlieb ..... 273/121 A

*Primary Examiner*—Raleigh W. Chiu
*Attorney, Agent, or Firm*—Rudnick & Wolfe; Michael L. Kenaga, Esq.

[57] ABSTRACT

A pinball machine which can be electrically linked to other pinball machines to allow the machines to communicate. Features on the pinball machines are synchronized to make gameplay more attractive to players. Cooperative or competitive gameplay can be provided between the pinball machines, but achievement of goals on the two machines is synchronized to maintain similar gameplay on both machines at any particular time.

15 Claims, 8 Drawing Sheets

LINKABLE PINBALL MACHINE

BACKGROUND OF THE INVENTION

The invention relates, generally, to pinball machines, and more particularly to an improved play feature for such games which is designed to foster and maintain player interest therein.

A typical pinball game includes an inclined playfield which supports a rolling ball, a pair of flippers, a vertical backbox containing the game electronics and a variety of play features. The person who plays the game has control of flippers mounted on the playfield which, when activated by the player at the appropriate time, propel the pinball across the playfield. A typical object of pinball games is for the player to direct pinballs at selected play features or targets to score points. When a ball passes into an out hole, the ball is no longer accessible and another ball is propelled onto the playfield. The duration of the game is normally determined by the length of time that a certain predetermined number of balls can be kept in play.

As will be appreciated, the success of a manufacturer's line of pinball games depends on its ability to attract players to its games. To attract players, it is necessary to provide new, exciting and challenging play features that test the player's skill in addition to entertaining the player.

Two or more players can be accommodated on a single playfield by playing in rotation, play passing from person to person each time a ball escapes from play. In multi-player situations there is clearly a drawback in that only one of the players is able to actively play the game at any one time.

In the field of video arcade games, particularly motor racing simulations, it is well known for two or more units to be linked together in such a way that two or more people can play in the same game simultaneously, whereby symbols representing all players are represented on the screens of other players, allowing the players to interact as if, for example, in a real race. Thus multiple player games are created with the advantages that players are not kept waiting to actively play the game, and that more enjoyment is generated by the direct competition.

The concept of linking two machines to allow several players to participate in a single game environment could not be applied directly to pinball machines, as ball movement on two machines clearly cannot be synchronized due to its chaotic nature.

SUMMARY OF THE INVENTION

The present invention provides a pinball machine which can be electrically coupled to at least one other pinball machine so that information can be shared between the two machines.

The present invention further provides a pinball machine which can be electrically connected to at least one other similar pinball machine, whereby information concerning the state of features of games being played on one of the machines can be transmitted to the other machine whereby affecting the gameplay on the other machines.

The present invention further provides a pinball machine which, when connected to another pinball machine, allows play to proceed on both pinball machines with gameplay features on each of the machines synchronized.

Throughout this description, the gameplay on a pinball machine is intended to mean any features of the pinball machine that affect the course of a game of pinball, once it is started on the machine. Thus activated features in a game would form part of the gameplay, as would the release of multiple balls, the moving of switches or the activation of solenoids. In contrast, the display of a score does not constitute gameplay, as displaying the score does not affect the course of a game.

Pinball games generally have a system whereby different goals or feature rewards such as multiball play or extra ball bonuses can be achieved by hitting various targets at the right time and in the right sequence. When such goals are achieved, an associated light will normally light up (or go out) to indicate that the goal has been achieved. Completion of a set and/or completion of the same goal a certain number of times lead to the completion of a further goal, and so on up a hierarchy until an overall goal is achieved.

When synchronizing gameplay between two machines on which players are competing against one another it would seem logical that a player on one machine achieving a goal on one machine, would not want this achievement to be synchronized with the achievement of the goal on another player's machine, as this would give the other player an unearned advantage.

However, if goals are not synchronized between machines, any other features that are synchronized between machines, such as the activation of multiball play, will not "fit in" with gameplay on the machine on which the feature was not initiated. This can be infuriating for the player who did not initiate the feature, particularly as he might not be in a position to make use of the feature with the current state of the game on his machine. For example, a multiball will clearly be far more advantageous when in a limited time high scoring mode, or after the achievement of a goal which increases the scoring value of targets.

Furthermore, if the state of the features on the playfields are all synchronized between linked machines, a much stronger sense of the link between the machines is felt, making the playing of linked games all the more exciting.

For these two reasons, the linking of features between machines, even in competitive modes of gameplay, is far more advantageous than keeping the completion of features separate.

Accordingly, it is a further object of the present invention to provide a pinball machine which can be linked to at least one other pinball machine such that the achievement of goals and the activation of different modes on one pinball machines initiates the same mode on the linked game.

It is also an object of the present invention to provide linked pinball games where players on different machines can compete against one another to score points.

It is also an object of the present invention to provide linked pinball games where players on different machines can cooperate to complete goals which might be very difficult or even impossible to achieve alone, such as the completion of a certain number of features in a limited time.

BRIEF DESCRIPTION OF THE DRAWINGS

The invention will be described with reference to the drawings in which.

DETAILED DESCRIPTION OF THE PREFERRED EMBODIMENTS

FIRST EMBODIMENT

Figures 1, 2:
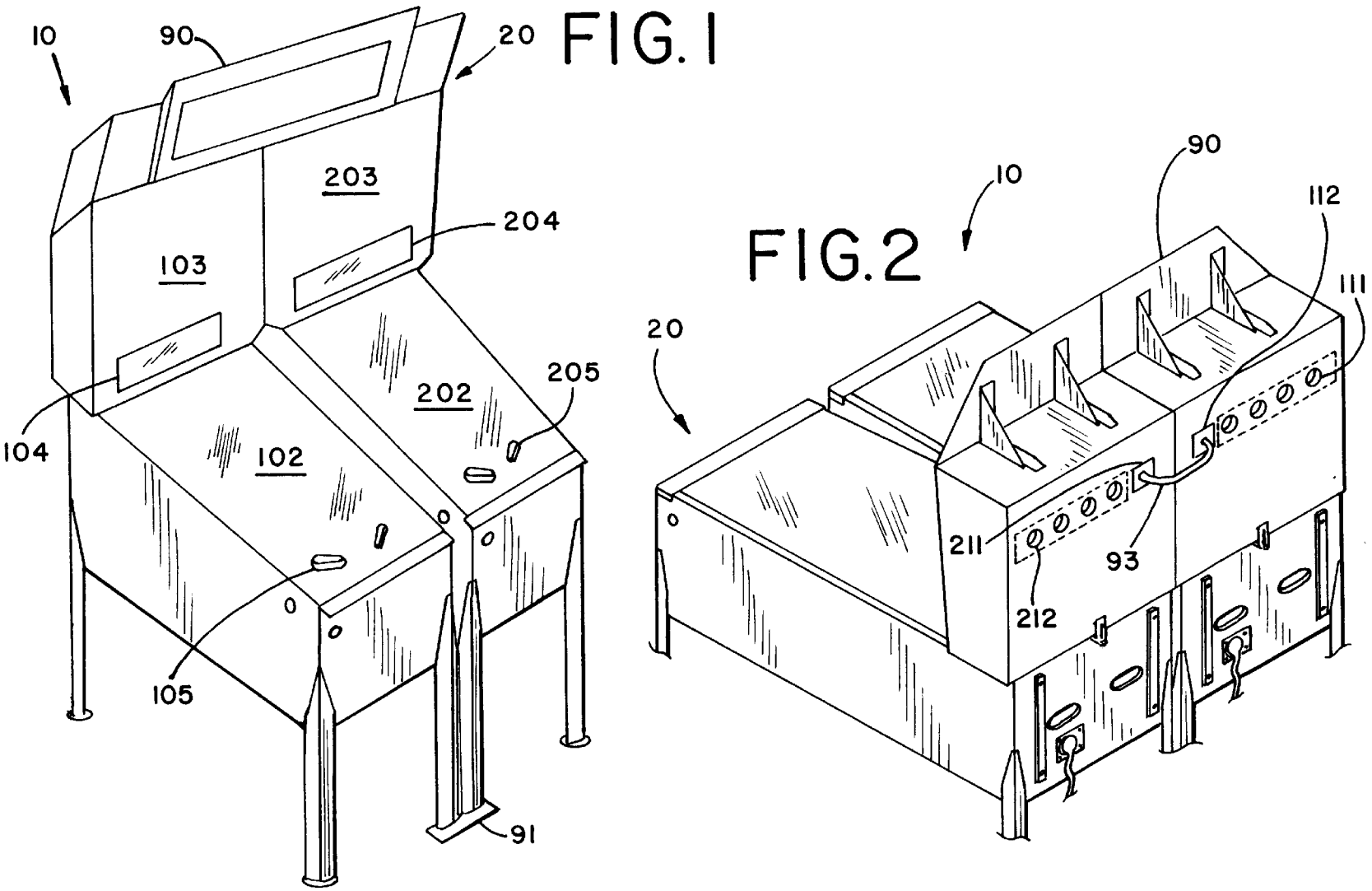
FIG. 1 shows two pinball machines according to a first embodiment of the present invention.
FIG. 2 shows a rear view of the two pinball machines of the first embodiment of the present invention.

A first embodiment of the present invention is shown in FIG. 1. Pinball games 10 and 20 are provided with playfields 102 and 202 and backboxes 103 and 203. The upper surfaces of the playfields are covered by a clear glass sheet. The playfield and the glass are inclined downwardly towards the front, or player end.

As in all standard pinball machines, the playfields have flippers 105 and 205 located close to the front end and operable by the user as well as components operated on impact by the pinball to propel the pinball in another direction. Sensors are also provided around the playfield to detect the path of the pinball and activate components appropriately, diverting the pinball.

The backboxes 103 and 203 of the pinball machines have displays 104 and 204 which display information about the progress of the game, in particular the score achieved on each machine, each under the control of a microprocessor 151;152. Special video based features of the game are also displayed by the displays 104 and 204.

Pinball machines 10,20 according to the present embodiment are configured so that they can be arranged side by side as shown in FIG. 1, in the same orientation.

The pinball machines may be mechanically connected to one another at the feet using one or more foot connecting plates 91. They may also be linked at the back or at the top of the back box. An add on marquee 90 can be located to provide an image or message straddling the backboxes of both machines 10 and 20 to provide further evidence of their linkage.

Alternatively, the two machines 20 and 21, although electronically interconnected, could be placed in separate areas of a room. However, placing the two machines side by side is advantageous to allow players to know that the two machines are connected and to permit observation of overall gameplay.

Figure 3:
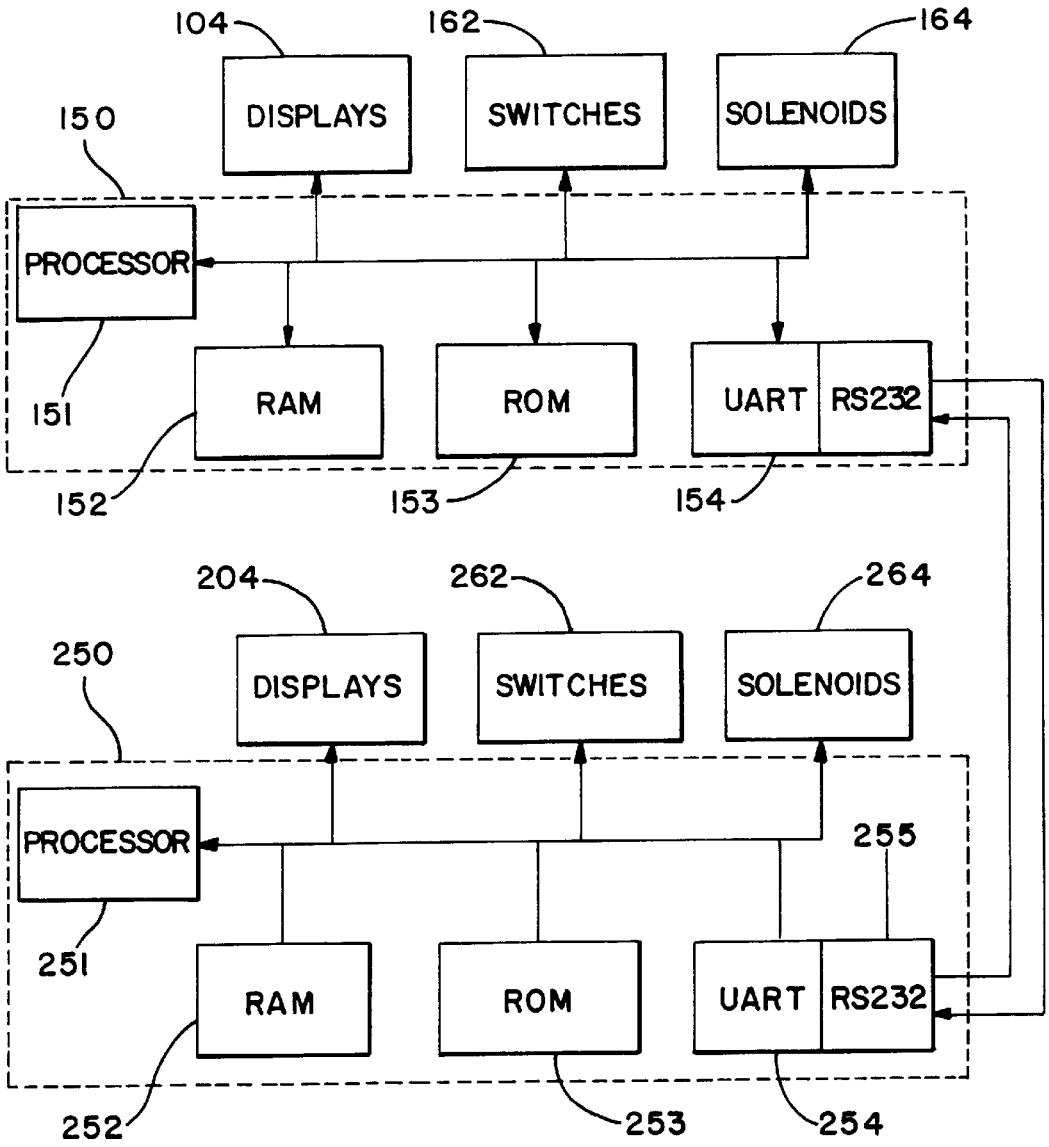
FIG. 3 shows the electrical connection of the pinball machines shown in FIG. 1.

The backboxes 103 and 203 contain the majority of the electronics of the pinball machines. In particular, as shown in FIG. 3, the backboxes contain microprocessor control systems 150 and 250. Each microprocessor control system contains a microprocessor 151;251 which controls the pinball machine and has control over an address and data bus 160;260, as well as all of the electromechanical features in the playfield, including playfield switches 162 and solenoids 164.

As is standard in pinball machines, a RAM 152,252 and a ROM 153, 253 are also connected to the address bus and the data bus on each machine providing software for the microprocessor to control the playfield features and the scoring mechanism, and providing writable memory to store the state of the game, high scores and other updatable information. The microprocessors 151;251 are also connected via the address bus and the data bus 160;260 to display units 104;204 on each of the back boxes which provide scoring information and/or video game features for players.

As shown in FIG. 2, two openings 111, 112; 212, 212 are provided in the rear of the backboxes of each machine allows access to the electronic circuitry within. Each machine has two openings, one at each side of the rear of the backbox. When the two machines are located next to one another, two of the four openings will be next to one another.

A cover plate may be provided to cover the openings which are not in use. When the plates are removed RS232 serial ports 155, 255 are exposed (FIG. 3) which form part of UART (Universal Asynchronous Receive/Transmit) interfaces 154 and 254 to link the address buses and data buses 160,260. Data can accordingly be received from and written to the RS232 ports 155, 255 under the control of microprocessors 151, 251.

An RS232 cable 93 is provided to connect the RS232 ports on the two pinball machines, such that data can be transmitted and received by each machine. Serial communication between UART interfaces, containing a standard UART processor (eg. the 16550A) is very well known in the art of computers and linked arcade games as a means for sending data bidirectionally between machines. Details of how the UART interface is addressed, and data sent thereto can be found in many reference books for desktop computers, for example the Hardware Bible, Winn L. Rosch (1997).

In other embodiments of the invention, the machines are connected by a parallel interface, ethernet or other network interfaces. The nature of the interface is not important to the invention as long as data can be transmitted bidirectionally.

When each of the pinball machines is switched on, it attempts to communicate with the other pinball machine via the UART interfaces 154 and 254. If there is no RS232 cable linking the two pinball machines or the other machine is switched off, the attempt will fail and the machine will proceed to operate as a normal pinball machine providing the features of a game under the control of software stored in RAM 152 AND ROM 153.

However, when the two RS232 ports are linked by a cable and both machines are switched on, the attempt to communicate will be successful. The microprocessors then communicate via the RS232 interfaces to identify the configuration of the other machine and assess compatibility. If the two machines are compatible, and can synchronize their game play, the two pinball machines will communicate while following a preset program as will be discussed hereinafter. If the two machines are of different types, they might synchronize attract mode features such as lights and sounds, and if totally incompatible, the machines will each independently follow a program similar to that followed if the RS232 cable were not present.

When a game is started on either machine 10;20, a message is sent by its microprocessor via the serial interface to the microprocessor on the other machine to prompt the other player to also start a game. The message can be in any format, as long as it can be unambiguously interpreted by the microprocessor on the other machine. For example, the message might comprise a unique "start" bit sequence, a unique code for identifying a feature on the pinball machine, one or more associated values, followed by a unique "end sequence".

Figure 4:
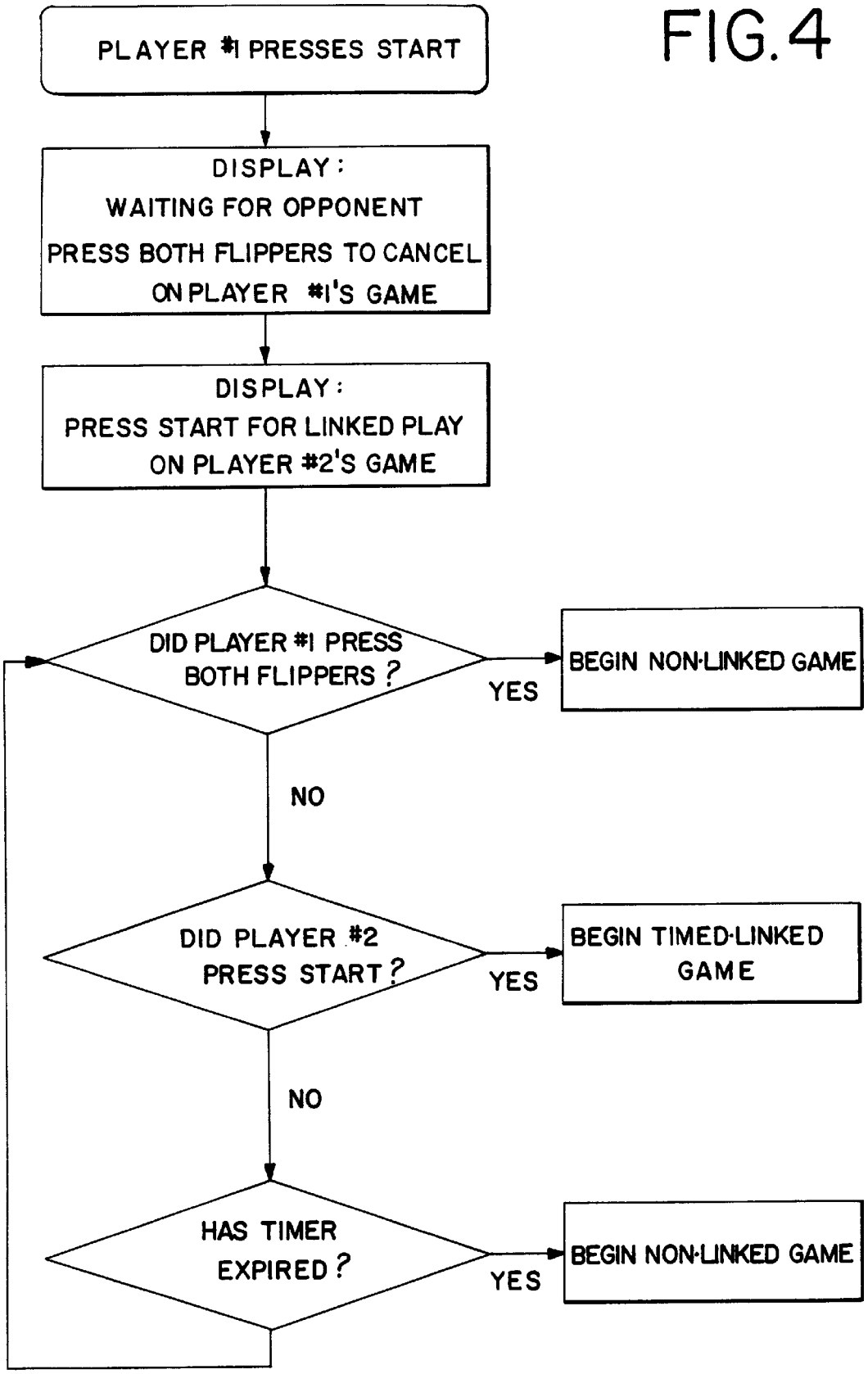
FIG. 4 shows a flowchart for game start up for the first embodiment of the present invention

If a game is already being played on the second machine, the program running on the microprocessor on the second machine sends a message back to the first machine using the same protocol causing the microprocessor on the first machine, to commence an independent game on. If the second machine is in attract mode, and a game is not being played, game start up proceeds as shown in FIG. 4. The microprocessor on the second machine sends a message to the microprocessor on the first machine, causing a prompt to be shown on its display unit that the machine is waiting for a player on the other machine or to press both flipper buttons to start a solo game. The program then enters a loop which is escaped from if a game is not started on the second machine within a predetermined time or the player on the first machine presses both the flipper buttons. In these cases, the program on the first machine commences single player gameplay. The loop is also escaped when the player on the second machine starts a game. If the player on the second machine starts a linked game, a message is sent back to the first machine to indicate a linked game has been started and the programs on both machines commence linked mode gameplay.

When the machines are linked, one of the two machines is determined to be the master and the other the slave. In this embodiment, identification numbers of all the machines taking part in the game are used to decide which machine is the master. Unique identification numbers are burned into the microprocessors of each machine. The machine with the lowest identification number, for example, is the master. However, there is no reason why another system should not be used; for example, the machine on which the game was started first could be determined to be the master.

Some events are driven by the master machine such as a game clock, monitoring the duration of the game and synchronizing events. When the master updates the game time clock, a message is sent from its microprocessor to the microprocessor of the slave machine via the serial interface to update the new clock value.

In a simple implementation of this embodiment of the present invention, the number of points scored on each machine is transmitted between the two machines, whereby the player on each machine can see how he is doing relative to the other player without needing to look at the other machine. Whenever the score changes, a message is sent from the machine on which the points were scored to the other machine, so that the score is updated on both displays. This feature is therefore driven by both master and slave.

Figure 8:
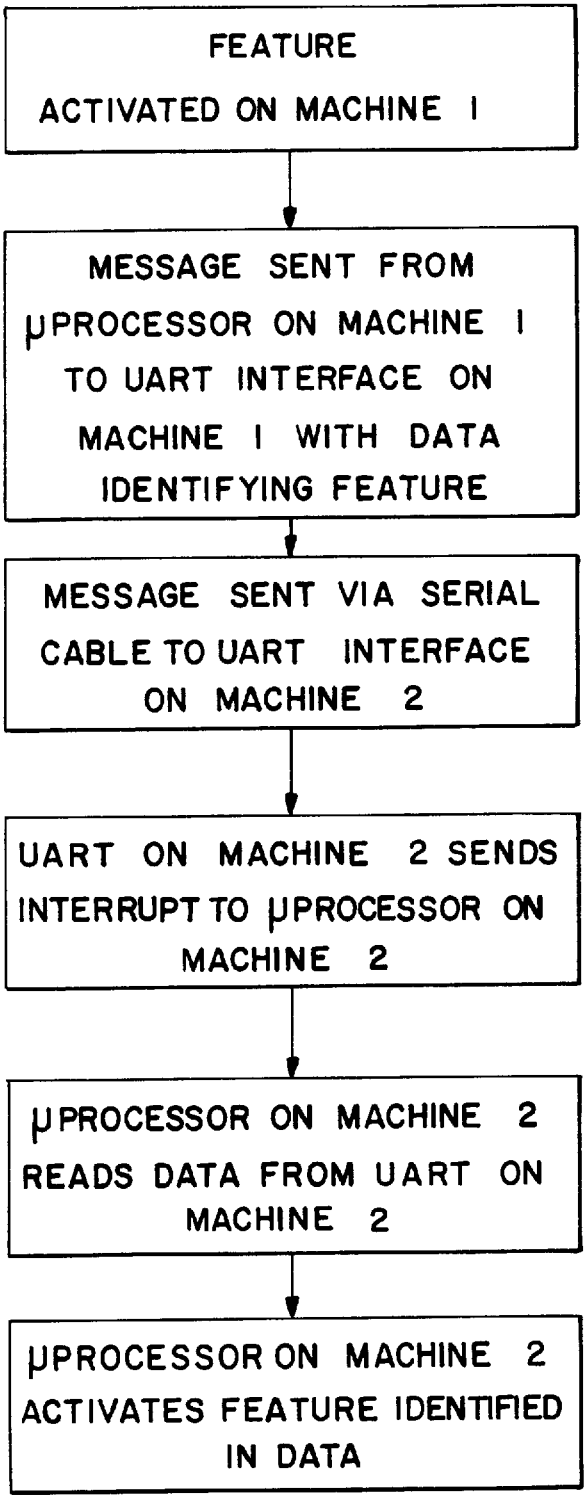
FIG. 8 shows a flowchart illustrating how simultaneous activation of features can be achieved between machines according to the first embodiment of the invention.

In an advantageous modification of this embodiment, messages are sent from one machine to the other machine when a certain feature on the machine is activated or when music or speech is started on that machine, so that appropriate action can be taken on the other machine, such as activating that feature or synchronizing the sound effects. A suitable mechanism for achieving this function using the UART interfaces on each machine is shown in FIG. 8.

When the feature is activated on one machine, a message is sent to the other machine containing data representing the feature activated. The UART transmits the message via the serial cable to the UART interface on the other machine. The UART interface on the other machine sends an interrupt to the processor on the other machine to alert it to the incoming message. The microprocessor on the other machine then reads in the message from the UART interface, and activates the feature identified therein.

As in all modem pinball machines, various "shots" can be made on the pinball playfield by shooting the pinball up various ramps and hitting targets. Making certain shots puts the game into different modes, in which the shots have different effects. Making shots might simply give a player points or might activate features such as multiballs. Making a certain combination of shots will achieve a goal, and enables the attempt at the completion of further goals. This proceeds until the overall goal of the game is achieved, time is up, or the player runs out of balls to play. A specific example of such a game is described later.

In a modification of the embodiment, when certain features on one machine are activated, such as multiballs, a message is sent to the other machine, which also activates the same feature. This gives a sense of the games being synchronized. However, shots being made on one machine, putting the game into a new state are not transferred to the other machine, as this would give the other player an undeserved advantage.

Synchronization is an important part of the invention. If the states of the two games are not synchronized, one player is left behind in the game. Features which are activated on his machine by the other player at a more advanced stage of the game can hinder rather than help the player to catch up, particularly if they do not fit into the pattern of play associated with a prior stage of the game. To an experienced pinball player, this incongruity between the state of his game and the activation of features such as multiball can be infuriating.

A further modification of the embodiment overcomes this problem. When a shot is made on one machine, and the state of the game changes (eg. the mode or the completion of a goal) a message is sent to the other machine detailing the event, and the equivalent event occurs on the other machine. The two machines are accordingly kept in the same state, and subsequent shots accordingly get the same score whichever machine they are made on. However, only the player on the machine on which the shot was made is awarded the associated points. Features such as multiball may or may not be activated on both machines, but if the fact that a multiball has been achieved on one machine affects further progression on that machine, a change of state is made on the other machine to ensure consistent play.

Thus, the game can be played competitively, both players only getting points for achieving their own shots, while still being synchronized as to modes of play and features. Thus both players, despite being in competition, can still work toward an overall goal together. This makes the game much more enjoyable to play, as the two players feel like they are playing in the same game, and synchronized features of the game occur at the same time. Furthermore, when a mode is entered in which there is a limited period of time to complete a set of goals, since both players enter the mode at the same time, they can cooperate to achieve the goals, making achievement much more likely. Both players might be identically awarded for achieving the goal or the award might be split according to who did the most to achieve the goal, for example by splitting the points according to the number of skill shots made.

According to a further envisaged modification of the embodiment, a shot achieved on one machine might have an effect on the score achieved on the other machine, or might influence the points awarded on the other machine for the next shot or the previous shot, while still maintaining synchronized gameplay. For example, if a shot were made on one machine, the points awarded might be cancelled or awarded to the other player if he performs a countermove within a certain time. This type of scoring system might be particularly suited to a game with a fighting or sport theme.

In a second embodiment of the invention, two or more pinball machines with the features of the first embodiment are linked together. Again, the machines can either be side by side or distributed over a wider area, while still being electrically connected. While this embodiment includes the case where only two machines are connected, the following description will predominantly refer to cases with three or more machines to emphasize the differences between this embodiment and the first embodiment.

Figure 5A:
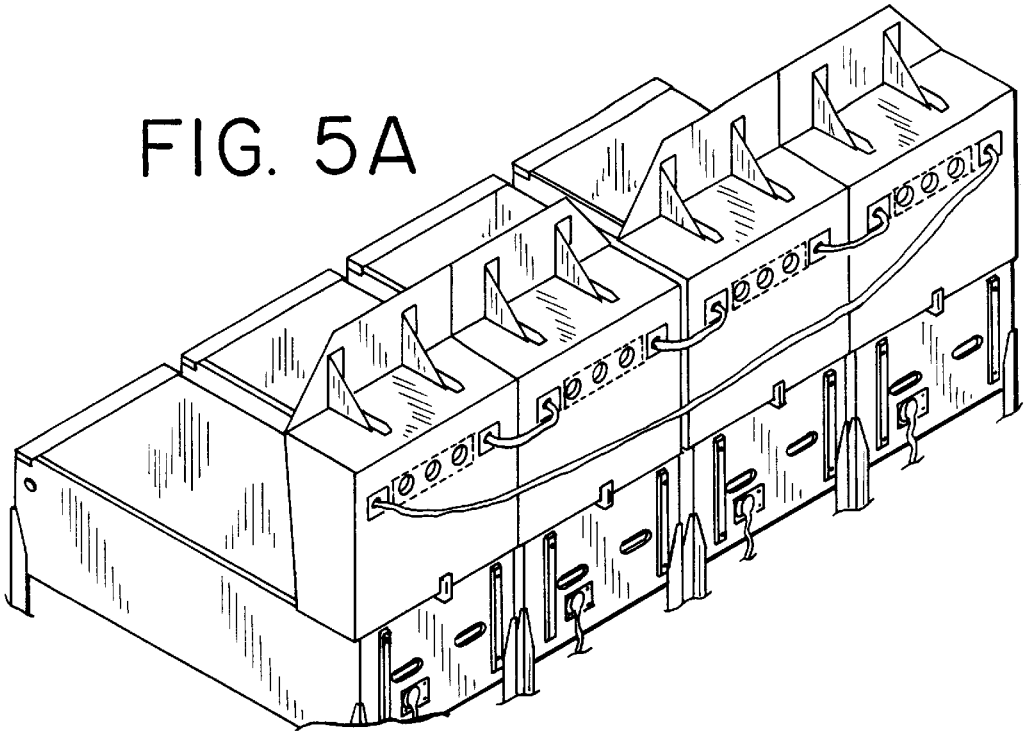
FIGS. 5A and 5B show rear views of three pinball machines of two versions of a second embodiment of the present invention.
Figure 5B:
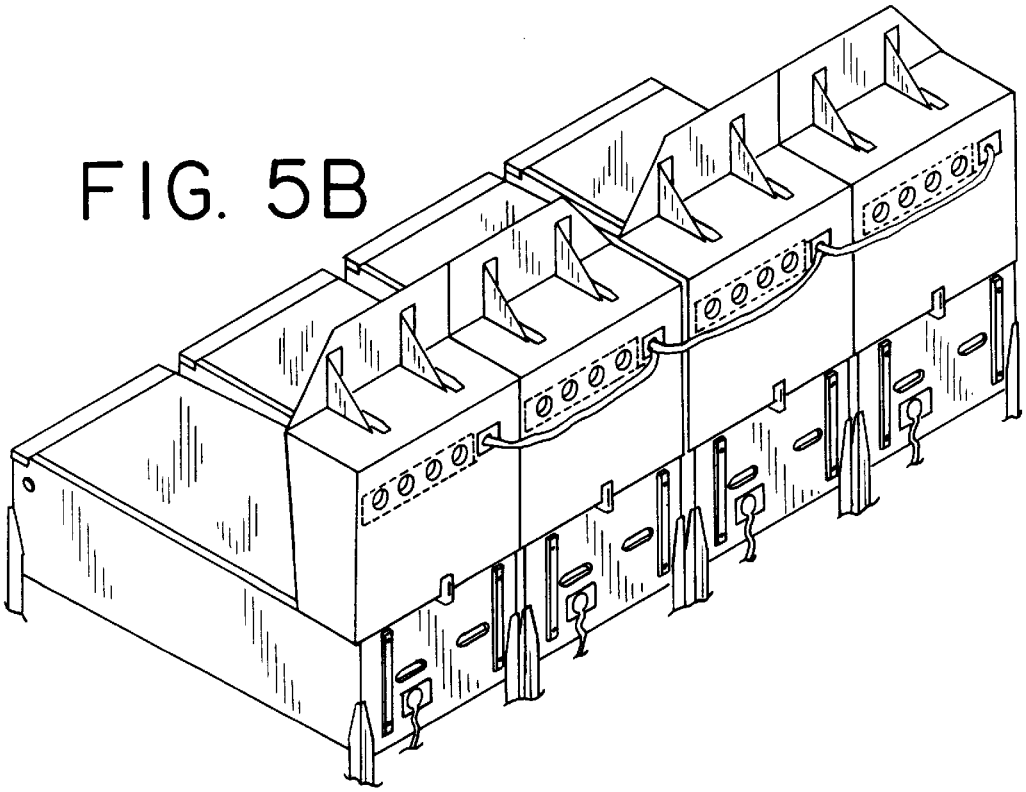
Figure 6:
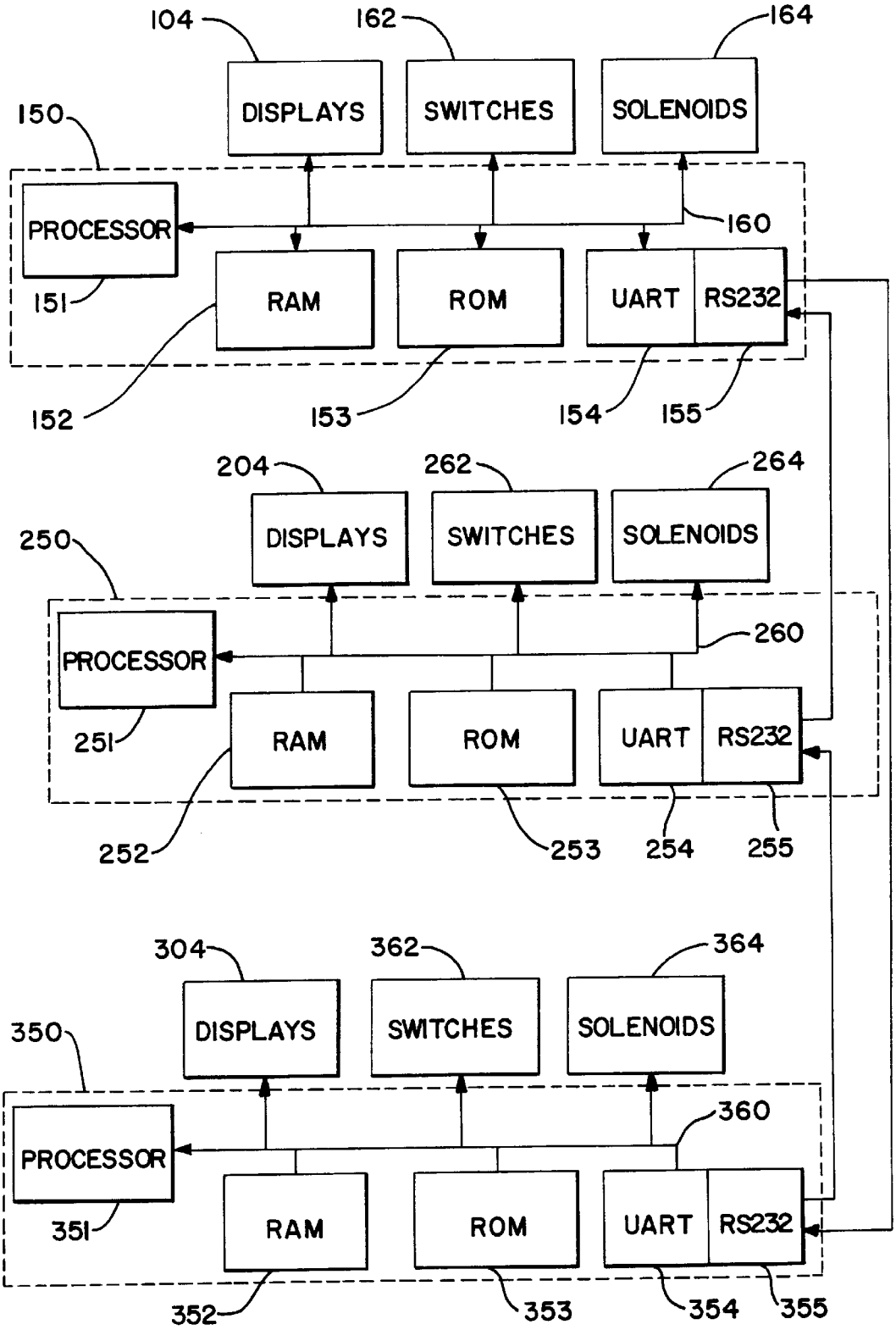
FIG. 6 shows the electrical connection of pinball machines according to the second embodiment of the present invention.

A plurality of machines of this embodiment are connected together via serial interfaces as in the first embodiment. However, according to this embodiment, the transmit and receive lines of the serial interfaces are arranged in a ring as shown in FIG. 6. This might be physically achieved by actually connecting the two ports on each machine in a ring as shown in FIG. 5A, one port being used to receive data and one being used to transmit data. Alternatively, a single port could be used on each machine as shown in FIG. 5B, and appropriately wired cables could achieve the necessary circuit arrangement. Signals are transmitted from the output of one serial port on a first pinball machine to the input of the serial port of a second machine. If there is a third machine, the output of the serial port of the second machine is transmitted to the input of the serial port of a third machine. This carries on in a loop until the output of a serial port of a machine is connected to the input of the serial port of the first machine.

As mentioned above, each machine on the ring is identified by a unique identifier burned into the microprocessor chip. In modifications of this embodiment of the invention, the identifier is stored in other ways, for example in a configuration of switches.

Messages are sent over the UART interfaces 154, 254 and 354 from game to game in order to communicate and coordinate gameplay between the pinball machines. In this embodiment, messages will normally also incorporate the identification numbers of the machine originating the message. It should be noted that identification numbers might also be incorporated in the messages according to the first embodiment so that software for machines according to the first and second embodiments can be kept identical. Tables are set up in the RAMs 152, 252 and 352 on each machine storing data about the identification numbers of each of the machines. When a pinball machine on the ring is switched on, the microprocessor on that machine sends a broadcast message to the other machines on the ring, giving its identification code. When an identifier is received by a machine, the machine adds it to its table of machines on the ring, for use in receiving from and sending messages to that machine.

Four types of message are sent over the serial ports:

1. Protocol maintenance message.
2. Broadcast messages are sent to all machines.
3. Game specific messages are sent to all machines of the specified game type.
4. Targeted messages are sent to a specific machine, where they are processed. Machines which receive a message not targeted to them only forward the message.

When one machine sends a message to another machine via the serial interface, the message is passed from the Transmit serial terminal being used on each machine to the Receive serial terminal on the next machine. If the microprocessor on the receiving machine does not recognize the identification code stored in the message of the intended recipient, it passes the message on to the next machine in the ring in the same manner. This proceeds until the target machine receives the message or the message returns to the sending machine. Messages sent to multiple machines are always passed to the next machine until the originating machine receives its own message.

This hardware/software mechanism provides the means to coordinate effects and gameplay, such as lights and activation of solenoids and switches simultaneously on any or all machines in the ring. It also allows the coordination of competitive or cooperative game play between two or more machines. It provides the communication path to allow data base information such as high scores and audits to be consistently maintained on all machines in the ring, or distributed from a master machine to slave machines if such an architecture is used. It also provides the ability for one machine to access the database information of all other machines on the ring.

Two machines of the same game type can coordinate linked game play and attract mode effects. Two machines of dissimilar types which use the same interface and protocol can coordinate attract mode effects such as commencement of sound and lights.

Figure 7:
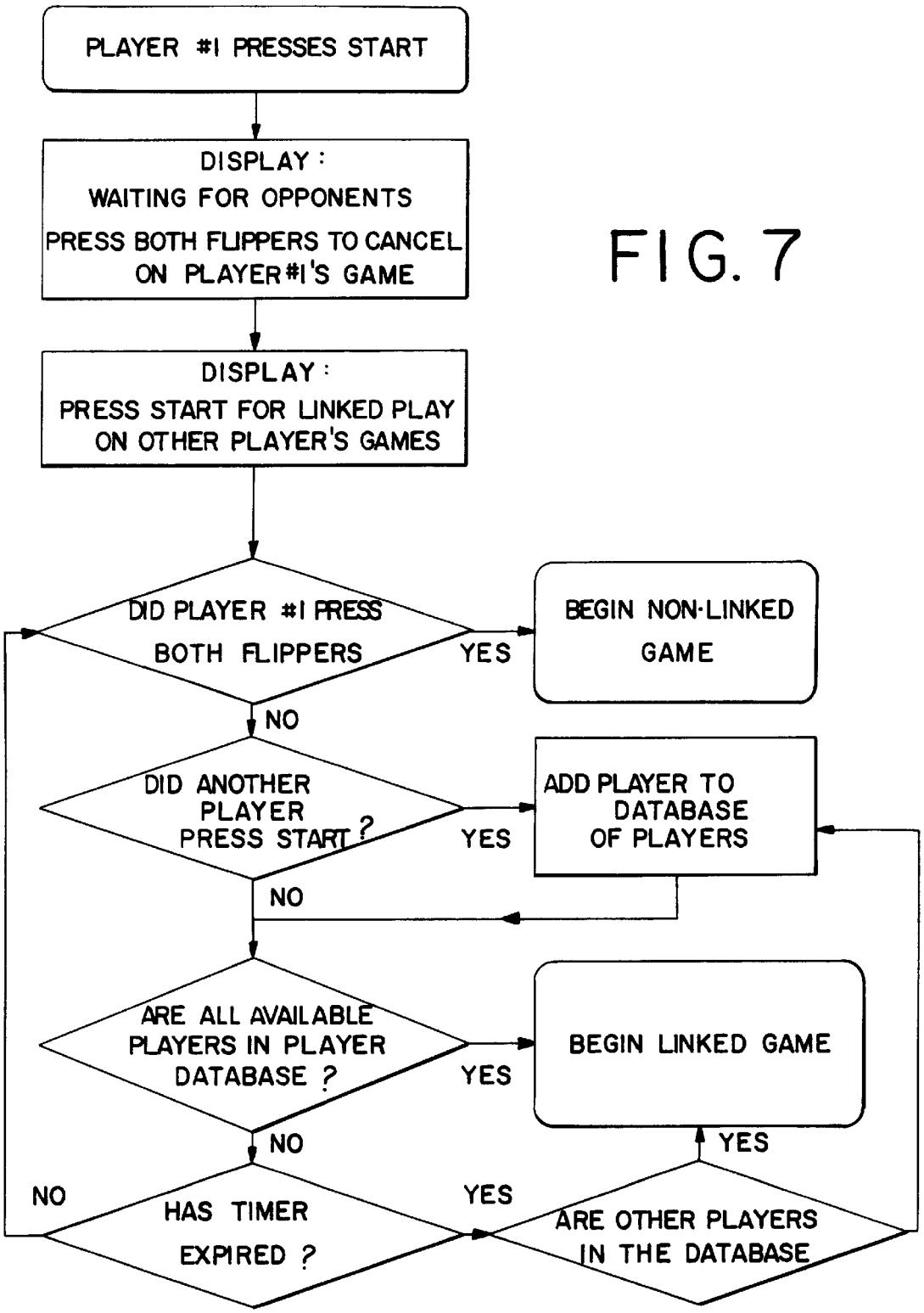
FIG. 7 shows a flowchart for game start up for the second embodiment of the present invention.

The start up procedure for games according to this embodiment is shown in FIG. 7. When a game is started on one machine, a broadcast message is sent to all other machines of the same type in the ring on which nobody is presently playing to prompt them to start a linked game. In this embodiment, the game starts when a predetermined time expires from the first player starting a game, or when all the games which could join in the linked game have joined. In this way, several people may join the same game rather than the two people who could play according to the first embodiment.

Figure 9:
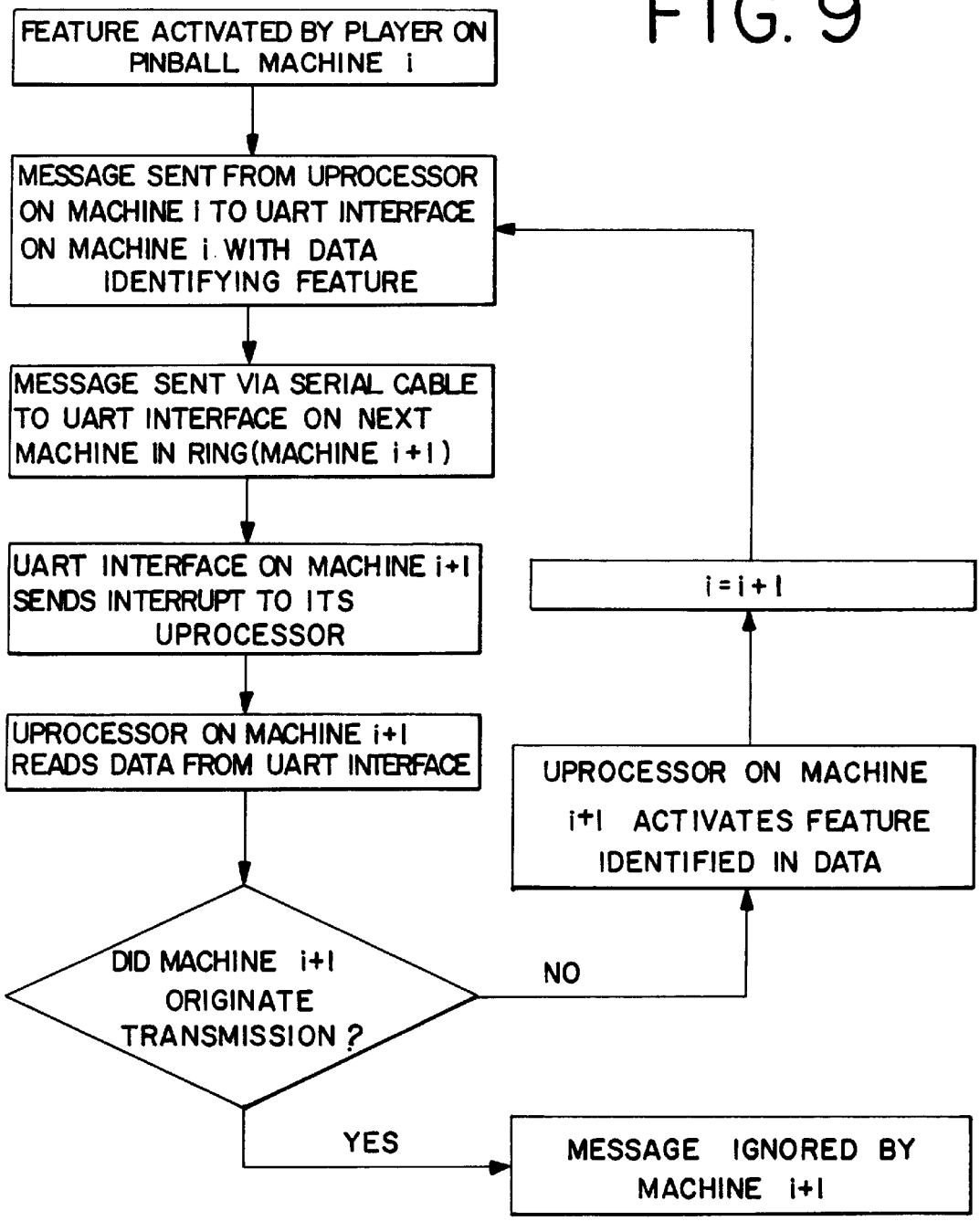
FIG. 9 shows a flowchart illustrating how simultaneous activation of features can be achieved between machines according to the second embodiment of the invention.

As in the first embodiment, features can be linked between pinball machines as shown in FIG. 9. A similar system is used to inform other machines that a feature has been activated to that used in the first embodiment. However, messages are sent from machine to machine informing each machine of the activated feature until the message returns to the first machine which does not pass it on. While FIG. 9 shows all of the machines activating the feature, modifications are envisioned in which only certain of the other machines activate the feature. For example, in a teamplay situation, described later, only members of the same team might get the feature activated.

The synchronization of balls according to either of the two embodiments can be achieved in several ways. The players on each machine might have a predetermined number of balls, which commence when a previous ball is lost, as in standalone pinball machines. This method has the disadvantage that the player who loses his balls quickest might finish a long time before the other player. Furthermore, he would only be playing in the low scoring early part of the game, which would be less satisfying.

Alternatively, each player could play with a predetermined number of balls, but release of the balls could be synchronized, so that a player losing his ball before another player only has to wait a short period for his next ball. This would allow a poorer player to take part in later stages of the game where more goals have been achieved.

A third alternative is for each pinball game to be of a set time duration, control of the ball being lost after the end of a set period. During this period, the player is given a new ball to launch into the play area each time a ball is lost. However, losing a ball has the negative effect of deactivating certain features and/or delaying his opportunity to score more points.

Games may also be split into separate periods such as two halves or four quarters. Between these periods the player might be given a rest period or the game might enter a special mode in which special features are available to add variety to the game. For example, the player might be given a short period in which to perform as many actions as possible, or repeat an action as many times as possible.

The "set duration" mode of play described for multi-player games may also be available in single player games, if desired.

If the game is operated on a timed basis, players may earn an extra period of time by achieving a certain score, in the same way that extra balls are often provided for obtaining a certain score when playing certain current pinball games.

In all the above embodiments, the game is played between players competitively, each player trying to score more points in the allotted time or the allotted number of balls. However, modifications of all the above embodiments are provided in which the game is played cooperatively between players, players helping each other to achieve high scores.

Embodiments are envisaged in which a set of goals is provided which, if completed, awards a free game. It could be very difficult for one player alone to complete the goals, but if each player works together to complete all of the goals, a free game can be won.

If the game has a scoring system whereby a low number of points is scored and a tie is feasible, a timed sudden death round, or an extra ball can be provided for each player, during which the first player to score enough points to beat the opponent wins. If the time expires, or player's ball leaves the field of play, the game is over.

In further modifications of the above embodiments, a tournament option is provided whereby multiple games played over a certain predefined period between two or more players contribute to a tournament score. Players taking part in a tournament are allotted an identifier so that they can be individually identified and games played by one player over a prolonged period can all be made to contribute to his tournament score.

In further modifications of the above invention, gameplay is linked but not synchronized, and different features are activated on each of the games. In competitive modes of play according to these modifications, activating positive features on one machine might deactivate positive features, activate negative features and/or decrease the score on any other connected machines.

In further modifications of the above embodiment, team-play is provided, whereby the points of two or more players are added together to give a team score. The team would normally be playing against a team of the same size on other linked machines. Full cooperation between players in the team would then be possible, and special features could be provided requiring players on cooperating machines to perform the same or different shots contemporaneously, whereby to achieve a goal. For example, in a game with a sport theme, one player might make a "pass" shot, and the other player makes a "shoot" shot, whereby completing a goal.

There follows an example of a game according to either of the embodiments described above which demonstrates game play objectives for a linked basketball game known as NBA Fastbreak and manufactured by Williams Electronics Games Inc.

The main playfield of this game has left, center and right ramps, which, when a ball is propelled up them, activate a basket feature on the backbox display, and return the ball to the playfield. A left loop and a right loop are provided which allow the ball into a separate "In the paint" area under certain circumstances. A set of Bumpers can also be reached by sending a ball up the right loop or when a ball is propelled into play. Various targets are situated around the main playfield. Hitting the pinball up one of the three ramps or around one of the two loops constitute the five main shots of the game.

A single player game is started, and the player is prompted on the display 104;204 to select his team. The player can use the flippers to cycle through a number of available teams.

A "SHOOT" button is provided on the front of the machine to launch the ball, and when this is pressed the selected team is locked in place. Each team has an associated current high score. If the player beats that score during their game, they will be asked to enter their initials and their score will replace the current high score for that team.

Scores are representative of a basketball game. Each basket shot during normal play scores 1, 2, or 3 points depending on the situation. In addition to points, good players will also collect "CHAMPIONSHIP RINGS". One ring is collected each time all six of the main goals are completed and the player wins a "TROPHY MULTIBALL" round described below. In terms of score comparisons, rings are more significant than points (e.g. 1 ring 100 points beats 0 rings 150 points).

The overall goal of the game is to compete for the high score for each of the teams and to complete the six main goals, described hereafter, to play a special mode called "TROPHY MULTIBALL". The goal is then to win at "TROPHY MULTIBALL" to collect "CHAMPIONSHIP RINGS" and to be the Most Valuable Player (M.V.P.). The M.V.P. is the last player to complete the six main goals and to win "TROPHY MULTIBALL". The initials of the current M.V.P. are shown during attract mode and during game play on the dot matrix display.

There are six main goals of the game that must be completed in order to play "TROPHY MULTIBALL". Each goal is completed by the criteria listed below:

1. "20 POINTS"
2. "MULTIBALLS"
3. "FIELD GOALS"
4. "COMBINATION SHOTS"
5. "POWER HOOPS"
6. "STADIUM GOODIES"

Once 20 points are achieved through any means of game play, the "20 POINTS" complete lamp is lit.

Once the two primary multiballs "SHOOT AROUND" and "AROUND THE WORLD" are played out, the "MULTIBALLS" complete lamp is lit.

Once the three types of "FIELD GOAL" (free throw, 2 point, 3 point) are made, the "FIELD GOALS" complete lamp is lit. Most baskets award a two-point field goal.

Once the four types of combination shots are made, the "COMBINATION SHOTS" complete lamp is lit. Each combination shot is made by making a first shot when the corresponding "LIGHT TIP-OFF", "LIGHT SLAM DUNK, "LIGHT ALLEY OOP, or "LIGHT FASTBREAK" is lit, lighting the associated light for the combination shot followed quickly by a second shot to the basket.

Once the four "POWER HOOPS" modes described hereinafter are played, the "POWER HOOPS" complete lamp is lit. Power hoop modes are entered sequentially by hitting specified bumpers. The modes are explained in greater below.

The "HALF COURT HOOPS" is the first "POWER HOOPS" mode. During this mode, the center ramp scores 3 points per shot. The mode is over when a "SHOT CLOCK" expires. The "HOOK SHOT HOOPS" is the second "POWER HOOPS" made. During this mode, the left ramp scores 3 points per shot. The mode is over when the SHOT CLOCK expires. The "RUN & SHOOT HOOPS" is the third "POWER HOOPS" made. During this mode, the left and center ramps are alternately lit and score 3 points when shot. The mode is over when the SHOT CLOCK expires. The "HOOPS MULTIBALL" is the fourth "POWER HOOPS" made. During this multiball, the left and right ramps are alternately lit and score 3 points when shot. If the left loop shot is made during any of the "POWER HOOPS" modes/multiball, "HOOP LOOPS" are tallied.

Once the four "STADIUM GOODIES" items have been collected, the "STADIUM GOODIES" complete lamp is lit. Each of these modes is entered by shooting the ball up a left eject passage.

The "PIZZA POWER SHOTS" mode is the first "STADIUM GOODIES" mode and is played entirely in the backbox (103) on the dot matrix display (104). Each time the player hits a flipper (or pushes the SHOOT button), a ball is flipped towards a basket on the display. If the ball goes through the hoop, the player scores the point value on the dot matrix display. The point value cycles between 1, 2 and 3 points. The mode is over when a "SHOT CLOCK" expires.

The second of the "STADIUM GOODIES" is the "HOT DOG MANIA" mode. During this mode, all shots made by the player cause the backbox display to show a 3 point basket being scored. In addition to points, the "SHOT CLOCK" time is reset to 24 each time a shot is made. The mode is over when the SHOT CLOCK expires. The third of the "STADIUM GOODIES" is the "TRIVIA QUIZ" mode. This mode is also played entirely on the dot matrix display. The player is presented with a randomly selected question and four answers. The flippers cycle through the answers. If the selected answer is correct, the player is awarded 10 points. If the selected answer is wrong, the player is awarded 1 point. The mode is over when either the "SHOT CLOCK" expires, or the SHOOT button is pressed. "EGYPTIAN SODA" is the fourth and final "STADIUM GOODIES" mode. During this mode, each ramp shot made by the player causes the backbox to show a three-point basket being scored. The mode is again over when the "SHOT CLOCK" expires.

The "In the Paint" area is an area of the playfield below the top lanes, under a basket. There are four positions where the ball can be held in a ring around the basket. Each of the four positions can either pass or shoot the ball toward the basket using a solenoid. There is also a defensive player mechanism which automatically moves between any position and the basket under the control of the microprocessor to block the player's shot to the basket. If the ball enters this area via either a left or right loop when "IN THE PAINT" is lit, the SHOT CLOCK is set to 24 seconds and begins counting down. The player must pass the ball to a position that is not defended and attempt to shoot a basket for 2 points, before the shot clock expires. Making a basket from a position lights the lamp at that position. If the shot clock expires before a basket is made, the ball is automatically passed out of the area and returned to the normal play field. Completing all of the lamps (making a basket from each position) starts "AROUND THE WORLD" multiball. During this multiball, one of the five main shots is lit. The lit shot changes either when it is made or after a short period of time. Making the lit shot scores one point for each ball remaining in play.

The "TROPHY MULTIBALL" timed three-ball continuous multiball is started when the six main goals are completed. During this multiball, the player competes for approximately one minute to beat a computer score. The multiball starts with the computer's score shown on the right of the display tied with the player's score shown on the left. The computer's score escalates randomly over the timed period. The player's score increases as shots are made. Once the time expires (as shown on the 24 "second" SHOT CLOCK), the flippers are turned off and the balls are drained. If the player beats the computer, a "CHAMPIONSHIP RING" is awarded. If the player ties the computer, a short sudden death round is played where the player has a certain amount of time to score before the computer scores. The first to score wins. In either case (win or lose) all of the six main goals are reset, and play begins again, with increased difficulty.

When two machines are connected, a different mode of game play occurs. Once a game has been started on both machines, as described above, both games proceed to team selection display as with non-linked game play. The number of players indicated on each display will however be two, along with a timer.

Linked game play consists of 4 quarters of time play, with a break at the half and a sudden death period at the end of a tied game as described above.

As each player completes a shot, such as one of the "COMBINATION SHOTS", "FIELD GOALS", "POWER HOOPS" or "STADIUM GOODIES" and/or starts a mode such as a multiball, the shot completed lamp is lit on both machines and/or the mode begins on both games and both players play the mode. During the modes, each player works to score the most points during the mode.

While the players compete head to head for points, they may also work together to complete all of the features of the game. If successful, they will both play TROPHY MULTIBALL in head to head competition and the winner will be awarded a RING and 1 credit. A tie awards both players a RING and 1 credit.

At half time, all currently running modes, etc. are terminated and all of the balls are drained for the half time show. The half time show consists of both players playing "PIZZA POWER SHOTS" as described above. At the end of the half time show, the third quarter is started.

At the end of the fourth quarter, all currently running modes, etc. are again terminated, and the winner is announced. In the case of a tied game, a "SUDDEN DEATH" timed round is started during which the first player to be ahead of the other player by two points or more wins. If the timer expires, then the game ends in a tie.

Extra balls are lit as they are in non-linked games. When an extra ball is collected the time for the current quarter is extended.

A plumb tilt terminates the game for the player who tilted. The other player finishes the timed game. A slam terminates the game for both players.

While we have shown and described preferred embodiments of the present invention, it will be understood by those of ordinary skill in the art that changes and modifications can be made without departing from the invention in its broader aspects. Various features of the present invention are set forth in the following claims.

What we claim is:

1. A pinball machine capable of being electrically connected to at least one similarly equipped pinball machine to permit cooperative and competitive interactive game play, said pinball machine comprising a) a playfield on which a pinball may roll;

b) means for player control of the pinball on said playfield;

c) targets at which the pinball may be directed to score points or to achieve game objectives;

d) a processor based control system including a game program to monitor game operation, monitor game play and compute player score, said game program permitting achievement of objectives on one of said pinball machines to influence gameplay on the other pinball machine, and vice versa;

e) said control system including interface means for electrically connecting said similarly equipped pinball machine(s) to said control system to allow the passage of information between the pinball machines.

2. The pinball machine of claim 1 wherein said interface means allows connection to more than one similarly equipped machine.

3. The pinball machine of claim 1 wherein the interface means includes a UART serial interface.

4. A pinball machine according to claim 1 wherein said game program allows game players to cooperate to achieve a game objective.

5. A pinball machine according to claim 1 wherein said game program includes goals for which various objectives need to be completed, wherein completion of objectives on one machine results in completion of the objectives on any connected machine.

6. A pinball machine according to claim 1 wherein activation of certain features of the game by one player causes the game program to change the state of features of the game on at least one of said at least one other machines to the disadvantage of a game player on said at least one other machine.

7. A method of playing a game on a plurality of similarly equipped pinball machines, each comprising:

a) a playfield on which a pinball may roll;

b) means for player control of the pinball on said playfield;

c) targets at which the pinball may be directed to score points or to achieve game objectives;

d) a processor based control system including a game program to monitor game operation, monitor gameplay and compute player score, said game program permitting achievement of objectives on one of said pinball machines to influence gameplay on the other pinball machine(s) and vice-versa;

said method comprising electrically connecting the control systems on said similarly equipped pinball machines whereby to allow the passage of information between the pinball machines.

8. The method of claim 7 wherein the connection of said pinball machines comprises the connection of each machine to more than one other similarly equipped machine.

9. The method of claim 7, wherein the information passed between machines allows game players to cooperate to achieve a game objective.

10. The method of claim 7 wherein said game program includes goals for which various objectives need to be completed, and wherein completion of objectives on one machine results in completion of the objectives on any connected machine.

11. The method of claim 7 wherein activation of certain features of the game by one player causes the game program to change the state of features of the game on at least one of said other pinball machines to the disadvantage of the other game player.

12. A pinball machine capable of operating both in a first configuration wherein said pinball machine is electrically and physically separate from any similarly equipped pinball machine and a second configuration wherein said pinball machine is in electrical communication with at least one similarly equipped pinball machine to permit cooperative and competitive interactive game play, said pinball machine comprising:

a) a playfield on which a pinball may roll;

b) means for player control of the pinball on said playfield;

c) targets at which the pinball may be directed to score points or to achieve game objectives;

d) a processor based control system including a game program to monitor game operation, monitor game play and compute player score, said game program permitting achievement of objectives on one of said pinball machines to influence gameplay on at least one other pinball machine connected thereto when in said second configuration;

e) said control system including interface means for electrically connecting said similarly equipped pinball machine(s) to said control system to allow the passage of information between the pinball machines.

13. A pinball machine according to claim 12 wherein said interface means allows connection to more than one other similarly equipped machine.

14. A pinball machine according to claim 12 wherein said game program includes goals for which various objectives need to be completed, wherein completion of objectives on one machine results in completion of the objectives on any connected machine.

15. A pinball machine according to claim 12 wherein activation of certain features of the game by one player causes the game program to change the state of the game on said at least one of said at least one other machines to the disadvantage of a game player on said at least one other machine.

* * * * *